United States Patent [19]

Sandell

[11] Patent Number: 4,486,317

[45] **Date of Patent: * Dec. 4, 1984**

[54] STABILIZATION OF THICKENED AQUEOUS FLUIDS

[75] Inventor: Lionel S. Sandell, Hagerstown, Md.

[73] Assignee: E. I. Du Pont De Nemours and Company, Wilmington, Del.

[ * ] Notice: The portion of the term of this patent subsequent to Apr. 19, 2000 has been disclaimed.

[21] Appl. No.: 415,681

[22] Filed: Sep. 7, 1982

Related U.S. Application Data

[63] Continuation-in-part of Ser. No. 225,725, Jan. 16, 1981, Pat. No. 4,380,482.

[51] Int. Cl.[3] ..... C06B 45/02; C09K 7/02; E21B 43/26

[52] U.S. Cl. ..... 252/8.5 A; 149/2; 149/21; 149/41; 149/47; 149/108.8; 252/8.5 C; 252/8.55 R; 252/315.3

[58] Field of Search ..... 252/8.5 A, 8.5 C, 8.55 R, 252/315.3; 149/2, 21, 36, 38, 41, 44, 47, 92

[56] References Cited

U.S. PATENT DOCUMENTS

| | | | |
|---|---|---|---|
| 2,417,307 | 3/1947 | Larsen | 252/8.5 |
| 2,908,597 | 10/1959 | Owen | 252/8.5 X |
| 3,113,059 | 12/1963 | Wayne et al. | 149/41 |
| 3,297,502 | 1/1967 | Chrisp | 149/6 |
| 3,367,805 | 2/1968 | Clay et al. | 149/6 |
| 3,371,037 | 2/1968 | Hitzman | 252/8.5 |
| 3,445,305 | 5/1969 | Lyerly | 149/39 |
| 3,453,158 | 7/1969 | Clay | 149/41 |
| 3,617,401 | 11/1971 | Mortensen et al. | 149/2 |
| 3,706,607 | 12/1972 | Chrisp | 149/2 |
| 3,713,918 | 1/1973 | Forshey et al. | 149/21 |
| 3,919,015 | 11/1975 | Bolza | 149/42 |
| 3,922,173 | 11/1975 | Misak | 252/8.55 X |
| 4,025,443 | 5/1977 | Jackson | 252/8.5 |
| 4,031,305 | 6/1977 | DeMartino | 536/114 |
| 4,169,798 | 10/1979 | DeMartino | 252/8.55 |
| 4,198,253 | 4/1980 | Kerchnerova et al. | 149/44 |
| 4,207,125 | 6/1980 | Grant | 149/109.4 |
| 4,359,392 | 11/1982 | Rygg | 252/8.55 |

FOREIGN PATENT DOCUMENTS

| | | | |
|---|---|---|---|
| 1321731 | 6/1973 | United Kingdom . | |
| 2055106 | 2/1981 | United Kingdom | 252/8.55 |

*Primary Examiner*—Herbert B. Guynn

[57] ABSTRACT

Thickeners, preferably galactomannans, in aqueous solutions or slurries, e.g., water gel explosives, oil well drilling muds, and hydraulic fracturing fluids, are stabilized against thermal degradation by incorporating iodide and/or iodate ions in the solution or slurry. The preferred stabilizer is the iodide ion introduced into the fluid by dissolving an alkali metal or alkaline-earth metal iodide, or ammonium or alkyl-substituted ammonium iodide, in the aqueous phase.

15 Claims, No Drawings

STABILIZATION OF THICKENED AQUEOUS FLUIDS

CROSS-REFERENCE TO RELATED APPLICATION

This application is a continuation-in-part of my copending application Ser. No. 225,725, filed Jan. 16, 1981, now U.S. Pat. No. 4,380,482.

BACKGROUND OF THE INVENTION

1. Field of the Invention

The present invention relates to fluids having a thickened or gelled aqueous phase, e.g., water-bearing explosives of the aqueous slurry type, hydraulic fracturing fluids used in gas and oil well stimulation, and oil well drilling fluids.

2. Description of the Prior Art

The suitability of aqueous fluids for practical use often depends on the presence therein of one or more thickeners or gellants to increase viscosity, prevent fluid loss, facilitate the dispersion of solids, confer water resistance, etc. For example, in gel- or slurry-type blasting agents and explosives, which comprise inorganic oxidizing salts, fuels, and sensitizers (one or more of each of these) dissolved or dispersed in a continuous liquid, usually aqueous, phase, the entire system is thickened and made water-resistant by the addition of thickeners or gellants such as galactomannans, which swell in water or other aqueous media to form viscous colloidal solutions or dispersions commonly referred to as "sols". Crosslinking of the galactomannan with an agent such as borax, potassium dichromate, or an antimony or bismuth compound converts the sol to a firmer gel form throughout which the other phases are dispersed.

Water-bearing explosives of the type described above, when stored for extended periods, especially with exposure to elevated temperatures, are susceptible to deterioration or degradation of varying degree, as evidenced by a reduction in the viscosity of sols and a softening or reduction in the firmness of gels, or, in extreme cases, by a virtual disappearance of the sol or gel structure with a resultant separation of solid and liquid phases. The utility of a given product at any given time will depend on the extent of the degradation which it has undergone. The inhibition of noticeable deterioration over extended periods is highly desirable because a composition which tends to thin out or soften during storage, while still of possible use in the thinned or softened state as a blasting agent or explosive, is of questionable value owing to the fact that such a condition may foreshadow a more catastrophic degradation, such as liquid separation, which can occur at any time. The complete disappearance of the sol or gel structure results in a product in which the other phases are no longer uniformly dispersed and for which resistance to dilution by water in the borehole has been lost. The resulting product can be difficult and sloppy to use, and no longer reliable in performance. Limp plastic film cartridges are difficult to load into boreholes, and are prone to becoming hung up or jammed in the hole. Also it may not be possible to position a blasting cap in cartridges which have become runny or soupy, and the explosive may well be lost to the surrounding formation when the cartridges are slit open.

The stability of a slurry-type explosive under a given set of time-temperature conditions depends on many factors including the type and amount of thickener therein, the salt/water ratio, the nature of the fuel(s) and sensitizer(s) present, and whether or not the thickener is crosslinked. Greater stability is generally shown, for example, by compositions having a thickener which is present in larger amounts and/or in crosslinked form. In some cases it may be possible to improve the storage stability or shelf life of a given product, e.g., by changing the nature of the materials therein or by increasing the amount of thickener, but it may not always be feasible to make such changes from a performance and/or economic standpoint.

Instability in slurry-type blasting agents heretofore often has been attributed to the presence of particulate aluminum which may be used as a fuel and/or a sensitizer. For example, U.S. Pat. No. 3,113,059 reports that aluminum reacts exothermically with the water in the blasting agent to form hydrogen, which constitutes an explosion hazard in the oxidizing environment and, in any event, degrades the product owing to the evaporation of water therefrom. The addition of an alkali metal or ammonium phosphate, preferably diammonium hydrogen phosphate, is said to inhibit the gassing resulting from the aluminum-water reaction. U.S. Pat. No. 3,367,805 states that inhibitors such as those disclosed and claimed in U.S. Pat. No. 3,113,059 may prevent, or assist in preventing, syneresis and hence stabilize the aluminum-containing composition physically. A phosphate-type stabilizer also is used in the aluminum-containing slurries of U.S. Pat. No. 3,453,158.

Mannitol and ammonium and alkali metal phosphates are described in U.S. Pat. No. 4,207,125 as corrosion inhibitors which may be incorporated into a thickened liquid pre-mix for a slurry explosive which is to contain particulate metal.

U.S. Pat. No. 3,297,502, which discloses that the desired consistency and stability in thickened aqueous explosives often are not achieved in the presence of reactive metals, teaches the protection of metallic fuel particles with a continuous, preformed coating of an oil and an aliphatic monocarboxylic acid.

In U.S. Pat. No. 3,445,305 the aqueous solution of inorganic oxidizing salt is reported as desirably retaining an alkalinity so as to preclude corrosion of equipment and prevent the contamination of blasting agent, particularly with regard to ions such as those of iron, copper, zinc, and aluminum, which, it is stated, would inhibit or destroy a gelling system.

Urea is taught in U.S. Pat. No. 3,713,918 as retarding gas evolution from metal-sensitized, crosslinked gelled slurry explosives, and a phosphate buffer is said to be important to avoid nullification of the long-term stabilizing effect of the urea.

It is disclosed in U.S. Pat. No. 4,198,253 that guar-thickened explosive slurries containing calcium nitrate, which are said to tend to degrade more quickly at elevated temperatures than do those devoid of this salt, can be made more stable by the use of a sulfonated guar gum derivative as the thickener.

In oil field operations, water-soluble polymers such as polygalactomannan gums are employed as viscosity-increasing agents in hydraulic fracturing fluids to improve the flow characteristics and the proppant-suspending ability of the fluids (proppants are non-compressible particulate materials such as sand, walnut shells, or glass beads, which become embedded in the cracks in the formation and hold them open and porous to flow after the hydraulic pressure is released). Polymers of this type also have been used as water-loss-control agents in the wellbore fluids used in drilling operations. In drilling muds, for example, the polymer is a thickener which controls fluid loss into the formation through the wall of the well. The drilling mud carries out the cuttings of the drill bits to the ground surface, and also serves to cool the bits. After removal of the cuttings, the drilling mud is recycled to the well.

One area of concern in the use of gum-thickened aqueous fluids in these oil field operations is the possibility that the thickener will degrade owing to the high temperatures encountered in use. One suggestion for improving thermal stability has been to modify the structure of the polygalactomannan gum, e.g., according to U.S. Pat. No. 4,031,305. This patent states that sulfohydroxypropyl ethers of polygalactomannans are superior to unmodified guar gum as gelling agents in oil well fracturing compositions because they are more heat-stable under fracturing conditions. This same patent also disclosed that sodium guar-2-hydroxypropylsulfonate is superior to guar gum in heat stability and viscosity recovery properties for application as a thickener in oil well drilling muds. Methyl ethers of the polygalactomannan gums also have been described as being more heat stable than the unmodified gum (U.S. Pat. No. 4,169,798).

U.S. Pat. No. 4,025,443 reports that magnesia or magnesium hydroxide extends the stability and effectiveness of hydroxyalkylated guar gum over a higher temperature range so that it can be used as a viscosifier in clay-free wellbore fluids.

SUMMARY OF THE INVENTION

This invention provides a method of inhibiting the thermal degradation of a thickener, preferably a natural or derivatized galactomannan or derivatized cellulose, for water in a thickened or gelled aqueous solution or slurry, e.g., a water gel explosive or a drilling or hydraulic-fracturing fluid, which method comprises incorporating in the solution or slurry a thermally stabilizing amount of iodide ion, iodate ion, or a combination of iodide and iodate ions. Preferably, substantially all of the iodine incorporated in the solution or slurry is chemically combined iodine, most preferably in the form of iodide.

The invention also provides an improved thickened or gelled aqueous solution or slurry comprising an aqueous phase containing a water thickener, preferably a natural or derivatized galactomannan or derivatized cellulose, optional suspended particulate matter, and iodide ion, iodate ion, or a combination of iodide and iodate ions as an inhibitor against the thermal degradation of the thickener.

In one embodiment the product of the invention is a water-bearing explosive comprising (1) oxidizer, (2) fuel, and (3) sensitizer components in a continuous aqueous phase having a thickened or gelled structure, and (4) iodide ion, iodate ion, or a combination of iodide and iodate ions as a stabilizer of the thickened or gelled structure.

The oxidizer component of the explosive consists essentially of one or more "inorganic oxidizing salts", which term, as used herein to define the oxidizer component, denotes salts of inorganic oxidizing acids exclusive of iodic acid. Thus, any iodate present in the explosive is present only in the small amount required to stabilize the thickened or gelled structure, as will be explained hereinafter, and forms no part of the inorganic oxidizing salt(s) used in larger amount in the oxidizer component.

In an alternative embodiment, the product of the invention is a water-based drilling fluid or "mud" containing (1) a finely divided weighting agent such as clay suspended in a water or brine continuous phase, (2) a water-loss control additive, i.e., a water thickener such as a polysaccharide, and (3) iodide ion, iodate ion, or a combination of iodide and iodate ions.

In still another embodiment, the product is an hydraulic fracturing fluid containing (1) a viscosity-increasing agent, i.e., a water thickener such as a polysaccharide and (2) iodide ion, iodate ion, or a combination of iodide and iodate ions.

In the past there have been a few isolated instances in which iodides or iodates have been suggested for specialized use in thickened or gelled aqueous solutions or slurries. In the main, this has been in water-bearing explosives containing dispersed gas bubbles in the sensitizer component. One of the ways in which the gas bubbles can be incorporated in the explosive is by the in situ generation of gas in a thickened aqueous phase by the decomposition of a chemical compound therein. U.S. Pat. No. 3,617,401, for example, discloses the use of hydrogen peroxide and a potassium iodide catalyst to produce gas in a slurry explosive in deep boreholes. Also, U.S. Pat. No. 3,706,607 discloses the use of hydrazine and an oxidizing agent such as hydrogen peroxide that aids in the decomposition of hydrazine to chemically foam water-bearing explosives containing non-oxidizable thickeners. Iodates are disclosed among the representative oxidizing agents reported to be useful in the latter process. British Pat. No. 1,321,731 also reports the chemical aerating of slurry explosives by means of a nitrogen compound such as hydrazine and hydroxylamine and certain derivatives thereof, and an oxidizing agent such as potassium iodate. These reactive systems constitute no part of the method or product of this invention, however, inasmuch as they can reduce the effectiveness of commonly used thickeners or gellants. Accordingly, the present solution or slurry is devoid of gas bubbles formed (a) by the decomposition of hydrogen peroxide when the degradation inhibitor contains iodide ion and (b) by the decomposition of a nitrogen compound (e.g., hydrazine or hydroxylamine) when the degradation inhibitor contains iodate ion.

In another patent relating to water-bearing explosives, U.S. Pat. No. 3,919,015, a large number of compounds of the lanthanide series of rare earth elements are disclosed as being useful as crosslinking agents for the galactomannan gums used as thickeners. Many cerous compounds, including iodide, are specified in the long list of crosslinking agents. Inasmuch as control of the function of a given stabilizing, or degradation-inhibiting, compound in the present product may be more easily accomplished if it is kept independent of the control of other functions such as crosslinking, the present product contains iodate ion as the inhibitor, and iodide ion is absent, when the cerous ion is present therein. In most instances, moreover, iodides and iodates of members of the lanthanide series of rare earth elements will not be present in the product because of their relative inaccessibility.

In the aqueous drilling fluids described in U.S. Pat. No. 3,371,037, an iodinated water-dispersible starch or gum is used as a fluid-loss control additive. The iodinated starch or gum is one which has been treated with elemental iodine to prevent bacterial degradation. This patent discloses that water, an organic solvent, or an alkali metal iodide may be used to prevent the vaporization of the elemental iodine. The present product contains iodate ion as the inhibitor of thermal degradation, and iodide ion is absent, when the solution or slurry is thickened with an iodinated water-dispersible starch or gum. This avoids the problem of the consumption of an iodide inhibitor possibly by reaction with free iodine.

DETAILED DESCRIPTION

The present invention is based on the discovery that small amounts of iodide or iodate ion inhibit the thermal degradation of thickened or gelled aqueous solutions or slurries, and, more specifically, the degradation of the thickener or gellant therein. This effect is seen in "sols" (viscous colloidal solutions, as in uncrosslinked systems) as well as in "gels" (crosslinked systems). The thickened structure of aqueous sols and the gelled structure of aqueous gels have improved stability or shelf life (in terms of the length of time at a given temperature before the structure gives evidence of deterioration) when the sol or gel contains a small amount of iodide and/or iodate ion. This improved stability is exhibited in sols and gels of varying composition, and is of particular importance in compositions which are especially susceptible to degradation, e.g., in water-bearing explosives in which a polysaccharide thickener such as a galactomannan gum is present together with finely divided aluminum, especially pigment-grade aluminum, or in those containing multivalent metal ion impurities.

The iodide and/or iodate ions are incorporated in the solution or slurry by the addition thereto of an iodide salt, an iodate salt, hydriodic acid, iodic acid, or any combination of these salts and acids, which is dissolved in the product's aqueous phase. For example, in the case of a water gel explosive, these iodine compounds, or an aqueous solution thereof, can be added to the aqueous liquor formed by dissolving the explosive's oxidizer component in water; or to the sol which forms when the aqueous liquor is thickened. Preferably, they are added before gelling has occurred.

The particular source of iodide or iodate ion added is not critical, provided that (a) it is sufficiently soluble in the aqueous phase to provide the desired concentration of iodide or iodate ion, and (b) it does not introduce cations in high enough concentration that would promote degradation of the sol or gel, or interfere with the functioning of the various components of the product. Mono- and divalent cations are preferred, and monovalent cations most preferred. Alkali metal and alkaline-earth metal iodides and iodates, as well as ammonium and alkyl-substituted ammonium iodide and iodate can be added, and, of these, the alkali metal salts, especially the sodium and potassium salts, are preferred for economic reasons. Other iodides and iodates, such as compounds of divalent zinc, iron, cobalt, and manganese, can be used, of course, when available although iodides and iodates of some of the elements, such as the above-discussed members of the lanthanide series, probably will remain only of academic interest and thus not preferred. In addition, the previously mentioned restrictions on the composition of the product will apply in the case of in situ gas-generating systems, and systems containing free iodine or cerous ion.

As is shown in Example 5 which follows, iodide ion has a stabilizing effect on the thickened structure of aqueous slurries when present in concentrations as low as 4 parts per million, based on the weight of the slurry. However, the stabilizing effect is greater with higher iodide concentrations, and for this reason preferably at least about 30, and most preferably at least about 60, parts per million of iodide ion will be employed. Iodide concentrations as high as about several percent can be used advantageously, however, as is shown in Example 11.

Iodate ion has a stabilizing effect in concentrations as low as about 100 parts per million (as is shown in Example 4 which follows), although at least about 200 parts per million preferably will be employed to achieve greater stability. Although iodate concentrations as high as about 0.6% can be somewhat effective, there is evidence that at higher concentrations more severe time-temperature conditions (longer time and/or higher temperature) may cause the iodate to become reduced to iodine, and the sol or gel structure to become weakened. Therefore, to provide stability under the more severe conditions, the iodate concentration does not exceed 0.3%, based on total product weight.

If the thickened or gelled structure is stabilized by a combination of iodide and iodate ions, the total concentration thereof may be as high as several percent, as was specified above for the iodide concentration, but the iodate concentration should not exceed 0.3%, as was specified above for the iodate concentration.

It is understood that, within the above-defined stabilizer concentration ranges, different concentrations may be required with different thickened aqueous solutions or slurries to achieve a given stability level. The reason for this is that the stability of the uninhibited thickened or gelled structure varies depending on the composition. For example, the less thickener or more finely divided aluminum that a composition contains, the more stabilizer it may require to achieve a selected stability level. Also, the presence of multivalent metal ions such as the aluminum ion, or precipitated aluminum compounds, in the composition may make higher stabilizer concentrations advisable.

This invention, when directed to water-bearing explosives, applies to any such explosive comprising oxidizer, fuel, and sensitizer components in a thickened or gelled continuous aqueous phase. The oxidizer component, which usually constitutes at least about 20% of the weight of the explosive, consists of one or more of the inorganic oxidizing salts commonly employed in such explosives, e.g., ammonium, alkali metal, and alkaline-earth metal nitrates and perchlorates. Specific examples of such salts are ammonium nitrate, ammonium perchlorate, sodium nitrate, sodium perchlorate, potassium nitrate, potassium perchlorate, magnesium nitrate, magnesium perchlorate, and calcium nitrate. A preferred oxidizer component consists of ammonium nitrate, most preferably in combination with up to about 50 percent sodium nitrate (based on the total weight of inorganic oxidizing salts), which affords a more concentrated aqueous liquor. Preferably, the concentration of the oxidizing salt(s) in the aqueous liquor is as high as possible, e.g., about from 40 to 70 percent by weight at room temperature. In addition, some of the oxidizer component may be present as a dispersed solid, i.e., that which has been added to the liquor and/or that which has precipitated from a supersaturated liquor.

Fuel components for water-bearing explosives containing an inorganic oxidizing salt component are well-known in the art, and any of these may be present in explosive products of this invention. Non-explosive fuels include sulfur and carbonaceous fuels such as finely divided coal, gilsonite, and other forms of finely divided carbon; solid carbonaceous vegetable products such as cornstarch, wood pulp, sugar, ivory nut meal, and bagasse; and hydrocarbons such as fuel oil, paraffin wax, and rubber. In general, carbonaceous fuels may constitute up to about 25, and preferably about from 1 to 20, percent of the weight of the explosive.

Metallic fuels which may be present in the explosive include finely divided aluminum, iron, and alloys of such metals, e.g., aluminum-magnesium alloys, ferrosilicon, and ferrophosphorus, as well as mixtures of such metals and alloys. The quantity of metallic fuels varies markedly with the particular fuel employed and can constitute up to about 50 percent of the total weight of the explosive. With finely divided aluminum, for example, about from 1 to 20 percent by weight usually is used; although up to about 40% may be used in special cases. With heavier metallic fuels such as ferrophosphorus and ferrosilicon, about from 10 to 30 percent usually is employed.

Water-insoluble self-explosive particles such as trinitrotoluene, pentaerythritol tetranitrate, cyclotrimethylenetrinitramine, and mixtures thereof can be used as fuels in the explosive, while acting as sensitizers as well. However, it is preferred that the fuel and/or sensitizer components of the explosive of this invention contain, instead of water-insoluble explosives, water-soluble explosives and preferably nitric or perchloric acid salts derived from amines, including the nitrates and perchlorates of aliphatic amines, most preferably lower-alkyl, i.e., 1–3 carbon, amines such as methylamine, ethylamine, and ethylenediamine; alkanolamines such as ethaanolamine and propanolamine; aromatic amines such as aniline; and heterocyclic amines such as hexamethylenetetramine. On the basis of availability and cost, nitric acid salts of loweralkyl amines and alkanolamines are most preferred.

Flake, or pigment-grade, aluminum also may be present in the sensitizer component.

Preferably, the amount of fuel component is adjusted so that the total explosive composition has an oxygen balance of about from −25 to +10% and, except for those compositions containing the heavier metallic fuels such as ferrophosphorus and ferrosilicon, preferably the oxygen balance is between about −10 and +10%. In special cases, the oxygen balance may be as low as −40%.

In addition to the above-mentioned fuels which in some cases function as sensitizers, the explosive may contain dispersed gas bubbles or voids, which are part of the sensitizer component, e.g., in the amount of at least about 5 percent of the volume of the water-bearing explosive. Gas bubbles can be incorporated in the product by dispersing gas therein by direct injection, such as by air or nitrogen injection, or the gas can be incorporated by mechanical agitation and the beating of air therein. A preferred method of incorporating gas in the product is by the addition of particulate material such as air-carrying solid material, for example, phenol-formaldehyde microballoons, glass microballoons, perlite, or fly ash. Evacuated closed shells also can be employed. While the gas or void volume to be used in any given product depends on the amount and nature of the other sensitizer materials present, and the degree of sensitivity required in the product, preferred gas or void volumes generally are in the range of about from 3 to 35 percent. More than about 50 percent by volume of gas bubbles or voids usually is undesirable for the usual applications where a brisant explosion is desired. The gas bubbles or voids preferably are no larger than about 300 microns.

As has been mentioned previously the gas bubbles also can be incorporated in the explosive by the in situ generation of gas in the thickened aqueous phase by the decomposition of a chemical compound therein, subject, however, to the limitations discussed above. When an explosive product of this invention contains both a nitrogen compound and an iodate, or both hydrogen peroxide and an iodide, the concentrations of the nitrogen compound, iodate, hydrogen peroxide, or iodide used are insufficient to produce a sensitizing amount of gas bubbles by reaction of iodate with the nitrogen compound, or by the iodide-catalyzed decomposition of hydrogen peroxide, and therefore the present explosive product is devoid of sensitizing gas bubbles formed by these reactions.

The thickener or gellant for the aqueous phase is a polysaccharide, usually a gum or derivatized cellulose. Galactomannans constitute one of the industrially important classes of gums which can be employed, and locust bean gum and guar gum are the most important members of this class. Natural and derivatized guar gums are preferred. Crosslinking agents preferably are used with galactomannan gums to hasten gel formation or to permit gel formation at relatively low gum concentrations. Such crosslinking agents are well-known, and include borax (U.S. Pat. No. 3,072,509), antimony and bismuth compounds (U.S. Pat. No. 3,202,556), chromates (U.S. Pat. No. 3,445,305), and organic titanates. Starch also may be used as the thickener, although at least about three times as much starch as guar gum usually is required. Combinations of thickeners also may be employed. Usually about from 0.1 to 5% galactomannan based on the total weight of the composition is employed.

In solutions or slurries thickened with guar gum, a pH of about from 2 to 11 should be maintained. Preferably, a pH of about from 4 to 10 will be used to reduce the chance of hydrolysis of the guar, which is more likely to occur at the extremes of pH. It iodide and iodate ions are both present, a pH above 7 should be maintained to prevent a reaction which could consume the stabilizing ions.

As is conventional in water-bearing explosives, explosives of this invention contain at least about 5%, and generally no more than about 30%, by weight of water. Preferably, the water content is in the range of about from 8 to 20% by weight based on the total composition.

The iodide or iodate which is added to the aqueous liquor or sol to form the product of this invention is dissolved therein and therefore is in the ionized form during preparation. However, the product may subsequently be subjected to conditions which cause some of the iodide or iodate to crystallize out of solution, but it is believed that at least a portion of iodide or iodate is present in the product in ionized form. Therefore, the terms "iodide ion" and "iodate ion", as used herein to denote the stabilizer, refer to iodide and iodate in dissolved as well as crystallized form.

In the following illustrative examples, parts and percentages are by weight.

EXAMPLE 1

Four different water gel explosives of the invention were prepared, two containing iodide ion, and the other two containing iodate ion.

Potassium iodide or iodate was dissolved in an aqueous solution (liquor) of about 73% by weight of monomethylamine nitrate (MMAN), which was at a temperature of 79°–82° C.; and this liquor was combined in a mixing vessel with an aqoueus solution (liquor) of about 75% by weight of ammonium nitrate, also at 79°–82° C. The pH of the combined hot liquors was adjusted to approximately 4.0.

The following solids were mixed into the liquors: stearic, acid ammonium nitrate prills, gilsonite, perlite, and chopped foil aluminum of a size such that 100 weight % of the particles passed through a 30-mesh, and 92% were held on a 100-mesh, screen (Tyler sieve). A mixture of sodium nitrate and hydroxypropyl-substituted guar gum was added, and mixing was continued for 3–5 minutes until thickening was observed. Pigment-grade aluminum was added to the thickened mixture (sol), and mixing continued until the aluminum was well-blended. This aluminum was a dedusted grade of flake aluminum coated with stearic acid and having a typical surface area of 3–4 $m^2/g$. A water slurry of potassium pyroantimonate (a crosslinking agent) was added 6.5–7 minutes after the addition of the guar gum, mixing continued for one more minute, and the product discharged into polyethylene cartridges. The final pH was 5.0–5.3.

One hundred parts of the resulting gel contained the following:

| Ingredient | Parts |
|---|---|
| Ammonium nitrate | 51.6 (47.9 added as prills) |
| Sodium nitrate | 10.0 |
| MMAN | 23.7 |
| Water | 10.0 |
| Pigment-grade aluminum | 2.0 |
| Foil aluminum | 1.0 |
| Gilsonite | 1.7 |

The gels also contained 1 part guar gum, 0.04 part stearic acid, and 0.0074 part potassium pyroantimonate per 100 parts of the above "basic" formulation, and sufficient perlite to produce a density of 1.20–1.23 g/cc. Gel 1-A contained 0.40 part, and Gel 1-B 0.160 part, of potassium iodide (0.031 part and 0.122 part of iodide ion, respectively), on the same basis. Gel 1-C contained 0.52 part, and Gel 1-D 0.207 part, of potassium iodate (0.43 part and 0.169 part of iodate ion, respectively), on the same basis.

In addition to Gels 1-A through 1-D, a control gel was prepared as described above, but without the addition of potassium iodide or iodate.

All five gels were stored for 13 weeks at 49° C. All gels in 5-cm diameter detonated before and after storage at 3400–3600 m/sec when initiated at −12° C. by a No. 6 electric blasting cap.

Gel strength was evaluated manually by checking uniformly dimensioned sections of gel for body and firmness, and resistance to tearing and compression. All gels were strong and firm prior to storage.

After storage, Gels 1-A, 1-B, 1-C, and 1-D still had a significant degree of gel structure, whereas the control gel had almost no gel structure left and was essentially a thick mush. The iodide- and iodate-containing gels had more body, resilience, and firmness than the control gel. Gel strength ranked, in decreasing order, as follows:

1-A = 1-B > 1-C > 1-D > control

Although iodide ion and iodate ion both inhibited gel degradation, iodide ion conferred a greater degree of gel stability than iodate ion at the inhibitor levels used.

EXAMPLE 2

The procedure described in Example 1 was repeated except that the ammonium nitrate liquor, aluminum, gilsonite, and stearic acid were omitted. Adipic acid was added along with the ammonium nitrate prills and perlite.

The gels had the following basic composition per 100 parts of gel:

Ammonium nitrate (added as prills): 32.7
Sodium nitrate: 14.8
MMAN: 38.3
Water: 14.2

In addition, the gels contained 1 part guar gum, 0.015 part adipic acid, and 0.0091 part potassium pyroantimonate per 100 parts of the above "basic" formulation, and sufficient perlite to produce a density of 1.02 to 1.05 g/cc. Gel 2-A contained 0.023 part, Gel 2-B 0.057 part, and Gel 2-C 0.113 part of potassium iodide (0.018, 0.044, and 0.086 part of iodide ion, respectively), on the same basis. Gel 2-D contained 0.073 part, and Gel 2-E 0.146 part, of potassium iodate (0.060 and 0.119 part of iodate ion, respectively), on the same basis.

Gels 2-A through 2-E and two control gels (which were the same as these except that they contained no iodide or iodate) were evaluated as described for the gels of Example 1. All of the fresh gels in 3.8 cm diameter denoted at about 3600–3700 m/sec when initiated at −7° C. by a No. 6 electric blasting cap.

After 5.5 weeks at 49° C., all of the KI- and $KIO_3$-containing gels were stronger than the two control gels. The gels ranked in strength as follows:

2C > 2-B > 2-A > 2-E = 2-D > control 1 > control 2

After 10.5 weeks at 49° C., the gels ranked the same, although some softening was noted. Gel 2-E showed signs of iodine evolution, and concomitant loss of strength.

Although iodide ion and iodate ion both inhibited gel degradation, iodide ion again conferred a greater degree of gel stability than iodate ion at the inhibitor levels used.

EXAMPLE 3

The procedure described in Example 1 was repeated to prepare two different gels (3-A and 3-B) with the exception that potassium iodide was dissolved in the ammonium nitrate liquor, which was heated to 60° C., and the MMAN liquor and foil aluminum were omitted. Two control gels also were made. These were the same as Gels 3-A and 3-B except that they contained no potassium iodide.

One hundred parts of each gel contained the following:

| Ingredient | Parts |
|---|---|
| Ammonium nitrate | 65.7 (20.2 added as prills) |
| Sodium nitrate | 11.1 |
| Water | 15.2 |
| Pigment-grade aluminum | 4.0 |
| Gilsonite | 4.0 |

The gels also contained 0.50 part guar gum (nonderivatized), 0.08 part stearic acid, and 0.0038 part potassium pyroantimonate per 100 parts of the above "basic" formulation, and sufficient perlite to produce a density of 1.18–1.21 g/cc. Gel 3-A contained 0.057 part, and Gel 3-B 0.114 part, of potassium iodide (0.044 part and 0.087 part of iodide ion, respectively), on the same basis. All gels in 5-cm diameter detonated at about 3300 m/sec when initiated at 10° C. by a No. 8 electric blasting cap.

After one week at 49° C., Gels 3-A and 3-B were both firm, dry, and strong, whereas the two controls had become totally degraded to a mush, with liquid separation.

The following examples (4 through 8) illustrate the effect of iodide and iodate ion in uncrosslinked thickened water-bearing explosives of the invention (sols). The stability of the sols was evaluated instrumentally by measurement of their viscosity with a Brookfield RVF viscometer operating at 20 rpm.

EXAMPLE 4

Potassium iodate was added to 400 grams of a saturated liquor consisting of 35.8% ammonium nitrate, 10.5% sodium nitrate, 39.2% MMAN, and 14.5% water in a 600-milliliter stainless steel container. The liquor was heated to 40°–60° C. with stirring to dissolve the iodate, then cooled to 26°–27° C., transferred to an 800-milliliter plastic container, and the pH adjusted to 5.0.

Four grams of hydroxypropyl-substituted guar gum was added slowly to the liquor, which was being stirred at about 1000 rpm with a three-blade propeller and shaft. Stirring at this rate was continued for 15 seconds after all of the guar gum had been added, and then the mixture was stirred at 500 rpm for 3.75 minutes. The mixture then was transferred to a 400-milliliter plastic container and placed in a 49° C. water bath for 12 minutes to allow hydration of the guar gum and formation of a thickened sol, after which time the sol was stirred rapidly for 30 seconds with a double-propeller shaft. Eight grams of the pigment-grade aluminum described in Example 1 then was added to the sirred sol, and stirring continued for 1.5 minutes at a speed sufficient to maintain a vortex in the thickened sol.

Five different sols were made, each with a different potassium iodate concentration. Two control sols also were made, both of which contained no iodate, and one of which (Control Sol 2) contained no aluminum. The sols were covered with plastic film and placed in a 49° C. water bath for 2 weeks. Sol degradation was determined by the drop in viscosity measured after 312 hours. The results were as follows:

| Sol No. | $KIO_3$ (g) | $IO_3^-$ (%) | Viscosity (cp) of Sol at Age 1 hr | 312 hrs |
|---|---|---|---|---|
| 4-A | 0.062 | 0.012 | 12890 | 5015 |
| 4-B | 0.123 | 0.024 | 13465 | 5615 |
| 4-C | 0.308 | 0.061 | 13545 | 5455 |
| 4-D | 0.62 | 0.123 | 13110 | 6145 |
| 4-E | 1.23 | 0.244 | 13000 | 7265 |
| Control Sol 1 | — | — | 14195 | 4415 |
| Control Sol 2* | — | — | 13400 | 6315 |

*Al-free

The results show that, while all of the fresh sols had viscosities of about 13,000–14,000 cp, after 312 hours Control Mix 1, which contained aluminum but no iodate ion, had a viscosity of only 4415 cp, in contrast to the iodate-containing aluminized sols, which had viscosities of 5015–7265 cp, indicative of the stabilizing effect of the iodate ion on the aluminized composition, increasing viscosity (and stability) having resulted with increasing iodate concentration in the range of 0.012% to 0.244%.

The results also show that a nonaluminized guar-thickened sol (Control Sol 2) also degrades when stored at 49° C. for 312 hours, but not to the extent that an aluminized sol does. Iodate ion in concentrations of 0.123% and 0.244% (Sols 4-D and 4-E) improved the stability of the aluminized sol to the degree that it equalled or exceeded that of the nonaluminized sol.

EXAMPLE 5

The preparation and test procedure described in Example 4 was repeated except that potassium iodide was substituted for the potassium iodate. Also, a more reactive form of pigment-grade aluminum was used. Two different series of sols were made. In one, Series II, the stirring for 15 seconds after the guar gum had been added was carried out at 800 rpm instead of 1000 rpm, and the hydration time was 11 minutes instead of 12. The aluminum used in the two series was taken from different manufacturer's lots. The results were as follows:

Series I

| Sol No. | KI (g) | $I^-$ (%) | Viscosity (cp) of Sol at Age 1 hr | 335 hrs |
|---|---|---|---|---|
| 5-A | 0.024 | 0.004 | 12965 | 2558 |
| 5-B | 0.048 | 0.009 | 13610 | 5865 |
| 5-C | 0.096 | 0.018 | 13270 | 5030 |
| 5-D | 0.239 | 0.044 | 13640 | 8260 |
| 5-E | 0.48 | 0.089 | 13925 | 9810 |
| 5-F | 0.96 | 0.178 | 12795 | 9815 |
| Control Sol 1 | — | | 12895 | 414 |
| Control Sol 2* | — | | 12640 | 6555 |

*Al-free

Series II

| Sol No. | KI (g) | $I^-$ | Viscosity (cp) of Sol at Age 1 hr | 308 hrs |
|---|---|---|---|---|
| 5-G | 0.0005 | ppm | 12930 | 4288 |
| 5-H | 0.0024 | 4 ppm | 13215 | 5780 |
| 5-I | 0.0048 | 9 ppm | 12945 | 5480 |

-continued

| Sol No. | KI (g) | Series II $I^-$ | Viscosity (cp) of Sol at Age 1 hr | 308 hrs |
|---|---|---|---|---|
| 5-J | 0.0096 | 18 ppm | 13360 | 6115 |
| 5-K | 1.0 | 0.18% | 13635 | 12525* |
| 5-L | 2.0 | 0.37% | 13205 | 12015* |
| 5-M | 4.0 | 0.74% | 12700 | 11950* |
| 5-N | 8.0 | 1.48% | 11330 | 10950* |
| Control Sol | — | — | 13085 | 4265 |

*Measured at sol age 306 hrs

With respect to Series I, all of the fresh sols, as in Example 4, had viscosities of about 13,000–14,000 cp. In this case, however, Control Sol 1, which contained aluminum but no iodide ion, had a 335-hour viscosity of only 414 cp (in contrast to Control Sol 1 of Example 4), indicative of almost complete degradation, presumably caused by the more reactive aluminum used. The stabilizing effect of the iodide ion at concentration levels of 0.004–0.178% on the Series I aluminized sol can be seen by contrasting Sols 5-A through 5-F, which had viscosities after 335 hours of 2558 to 9815 cp (increasing with increasing iodide concentration), with Control Sol 1 (414 cp). Moreover, iodide ion in concentrations of 0.044%, 0.089%, and 0.178% (Sols 5-D, 5-E, and 5-F) improved the stability of this aluminized sol to the degree that it exceeded that of the non-aluminized sol (Control Sol 2).

In Series II, the control sol was the same as Sols 5-G through 5-N except that it contained no iodide (i.e., it was an aluminized sol). Possibly owing to a difference in the purities of the aluminums from the two different lots, the Series II control sol degraded less during 49° C. storage than Control Sol 1 of Series I, but nevertheless showed a considerable degree of degradation. The results of the Series II tests show that iodide ion in concentrations as low as 4 parts per million exerts a degradation-inhibiting effect in aluminized sols, and that iodide ion concentrations of about from 0.2% to 1.5% result in little if any degradation over a 306-hour period at 49° C.

EXAMPLE 6

Two sols (6-A and 6-B) were prepared by the procedure described in Example 4 with the exception that no aluminum was added to either sol, and potassium iodide was substituted for potassium iodate in Sol 6-B. After the 12-minute hydration period, the sols were stirred for 2 minutes prior to storage at 49° C. The results were as follows:

| Sol No. | Inhibitor (g) | | Viscosity (cp) of Sol at Age 1 hr | 356 hrs |
|---|---|---|---|---|
| 6-A | $KIO_3$ | (3.08) (0.623% $IO_3^-$ | 12675 | 8790 |
| 6-B | KI | (0.48) (0.091% $I^-$) | 12150 | 9125 |
| Control Sol | — | | 12985 | 6700 |

The control sol was the same as Sols 6-A and 6-B except that it contained neither iodate nor iodide ion. The results show that guar-containing sols containing no aluminum also are stabilized against degradation by the iodide and iodate ion. The results also show that iodide ion is effective as a degradation inhibitor at a lower concentration level than iodate ion.

EXAMPLE 7

The procedure described in Example 4 was repeated except that calcium iodide was substituted for the potassium iodate. Three sols (7-A, 7-B, and 7-C) were prepared containing different calcium iodide concentrations. A control sol, which was the same as Sols 7-A through 7-C except that it contained no iodide, also was prepared. The results were as follows:

| Sol No. | $CaI_2$ (g) | $I^-$ (%) | Viscoity (cp) of Sol at Age 1 hr | 218 hrs |
|---|---|---|---|---|
| 7-A | 0.21 | 0.044 | 13365 | 12755 |
| 7-B | 0.53 | 0.111 | 12470 | 12040 |
| 7-C | 1.05 | 0.220 | 11575 | 11570 |
| Control Sol | — | — | 12915 | 8210 |

The sols which contained calcium iodide showed little evidence of degradation (decrease in viscosity) after 218 hours at 49° C., whereas these conditions produced a substantial decrease in viscosity, indicative of a substantial degree of degradation, in the sol which contained no iodide.

EXAMPLE 8

The procedure of Example 4 was repeated with the exception that the 4 grams of guar gum was replaced by 16 grams of a room-temperature-dispersible starch. Hydration time in the 49° C. water bath was 11 minutes. The results were as follows:

| Sol No. | Inhibitor (g) | | Viscosity (cp) of Sol at Age 1 hr | 384 hrs |
|---|---|---|---|---|
| 8-A | KI | (0.239) (0.043% $I^-$) | 12385 | 5880 |
| 8-B | $KIO_3$ | (1.23) (0.237% $IO_3^-$) | 11510 | 5290 |
| Control Sol 1 | | — | 12105 | 4420 |
| Control Sol 2* | | — | 12620 | 6085 |

*Al-free

The aluminized starch-thickened sols containing iodide or iodate ion were less degraded after 384 hours at 49° C. (as evidenced by the decrease in their viscosity) than the aluminized control sol. At the level of inhibitor concentration used, the iodide-containing sol exhibited about the same stability as an iodide-free sol containing no aluminum.

EXAMPLE 9

The procedure described in Example 4 was modified in the following manner:

After the pigment-grade aluminum had been added, stirring was continued for 30 seconds, and then one milliliter of a 1.07% aqueous potassium pyroantimonate solution was injected into the sol dropwise. Stirring was continued for an additional minute. The mix was covered with plastic film and set aside overnight at room temperature to allow crosslinking. Then it was placed in the 49° C. water bath and monitored for degradation or weakening by estimating the relative gel strength by measurements made with a cone penetrometer produced by the Precision Scientific Company. The instrument was fitted with a 60° Delrin ® cone and an aluminum spindle (26.1 gram moving mass). The depth of penetration of the cone into the gel was measured 10 seconds after the cone was released. A lower penetrometer reading (less cone penetration) indicated a stronger gel.

Six different gels were made, three of which contained iodide ion, and the three others iodate ion. Two control gels also were made, both of which contained neither iodide nor iodate, and one of which (Control Gel 2) contained no aluminum. The results of the penetrometer tests were as follows:

| Gel No. | Inhibitor (g) | | Penetrometer Readings (× 0.1 = mm) on Gel at Age ~45 hrs | ~240 hrs |
|---|---|---|---|---|
| 9-A | $KIO_3$ | (0.062) (0.012% $IO_3^-$) | 235.8 | 305.0 |
| 9-B | $KIO_3$ | (0.308) (0.061% $IO_3^-$) | 234.8 | 296 |
| 9-C | $KIO_3$ | (1.23) (0.244% $IO_3^-$) | 231.2 | 289 |
| 9-D | KI | (0.048) (0.009% $I^-$) | 224.8,235.6** | 284.7,283** |
| 9-E | KI | (0.239) (0.044% $I^-$) | 231.4 | 278 |
| 9-F | KI | (0.96) (0.178% $I^-$) | 235.0 | 277 |
| Control Gel 1 | | | 232.8 | 315.2 |
| Control Gel 2* | | | 236.0 | 288.6 |

*Al-free
**Duplicate gels

The penetrometer results show that although the strength of the inhibitor-free aluminized gel (Control Gel 1) at an early period was about the same as that of gels containing iodide or iodate ion, this control gel was weaker than the inhibited gels after 240 hours. As was found in the case of sols (Examples 4 and 5), stability increased (penetrometer reading decreased) as inhibitor concentration increased. The stability of the iodide-containing aluminized gels was equal to, or greater than, that of the nonaluminized control.

EXAMPLE 10

The procedure described in Example 9 was repeated with the following exceptions:

The nitrate liquor was prepared by adding ammonium nitrate prills to a hot waste liquor which consisted essentially of 29.7% ammonium nitrate, 8.7% sodium nitrate, 17.1% MMAN, and 44.5% water, and contained trace amounts of other metal ions, chiefly aluminum ion at a concentration of 2955 parts per million, as determined by Plasma Emission Spectroscopy. The prills were added in the amount of 78 grams per 100 grams of hot waste liquor. This increased the total nitrate salt concentration of the waste liquor to 75%. Ten parts of this 75% nitrate liquor then was added to 90 parts of the saturated nitrate liquor described in Example 4. The composition of the combined liquors was as follows:

Ammonium nitrate: 38.3%
Sodium nitrate: 9.9%
MMAN: 36.2%
Water: 15.6%
Aluminum (as ions or in precipitated form: ~166 ppm This liquor was converted into a gel by converting it first into a sol as described in Example 4, except that potassium iodide was substituted for the potassium iodate. The sol, which contained pigment-grade aluminum, was converted into a gel, stored, and tested as described in Example 9. In this instance, however, the moving mass of the penetrometer cone and spindle was 36.5 grams.

Two gels were made containing iodide ion. Two control gels also were made, both of which contained no iodide ion. Control Gel 1 was made with the waste liquor as described above; Control Gel 2 was made in the same manner except that the liquor was totally virgin liquor prepared as described in Example 4. The results of the penetrometer tests were as follows:

| Gel No. | KI (g) | $I^-$ (%) | Penetrometer Readings (× 0.1 = mm) on Gel at Age 26 hrs | 240 hrs |
|---|---|---|---|---|
| 10-A | 0.24 | 0.045 | 267.6* 265.8* | 345.8* 349.2* |
| 10-B | 0.96 | 0.178 | 271.0 | 339.0 |
| Control Gel 1 | — | — | 268.6 | 372.4 |
| Control Gel 2** | — | — | 262.8 | 353.0 |

*Duplicate mixes
**Virgin liquor only

The penetrometer readings for the iodide-containing gels and Control Gel 1, which, like Gels 10-A and 10-B, was made with waste liquor and contained ~166 ppm of aluminum (ion or precipitated), show that although gel strength was about the same at an early period, the iodide-containing gels remained more stable (gave lower readings) over a 240-hour period. Comparison of the results obtained with the two control gels shows that aluminum ion or precipitated aluminum compounds in the nitrate liquor exert a detrimental effect on gel stability. This effect can be offset by means of the present invention, however. A comparison of the results obtained with Gels 10-A/10-B and Control Gel 2 shows that an iodide-containing gel made with waste liquor is more stable after 240 hours than an uninhibited gel made with totally virgin liquor.

The following examples illustrate the utility of the presence of iodide ion in a sol which can serve as the basis for a hydraulic fracturing fluid or a drilling fluid.

EXAMPLE 11

Potassium iodide was dissolved in 400 grams of a 10% solution of potassium chloride in deionized water. Potassium chloride in a fracturing fluid is useful in preventing swelling in clay formations.

Four grams of hydroxypropyl-substituted guar gum was added slowly to the solution, which was being stirred in an 800-milliliter beaker at about 900 rpm with a three-blade propeller and shaft. Stirring at this rate was continued for 15 seconds after all of the guar gum had been added, and then the mixture was stirred at 500 rpm for 4 minutes. The guar gum became hydrated, as evidenced by the formation of a thickened sol.

Five different sols were made, each with a different potassium iodide concentration. A control sol, which contained no iodide, also was made. The sols were placed in a 93° C. water bath for about five days. Sol degradation was determined by the drop in viscosity measured over this period of time. The results were as follows:

| Sol No. | KI (g) | $I^-$ (%) | Viscosity (cp) at Age 1 hr | 2 hrs. | 3 hrs. | 4.5 hrs. | 21 hrs. | 121 hrs. |
|---|---|---|---|---|---|---|---|---|
| 11-A | 0.4 | 0.08 | 1116 | 879 | 947 | 846 | 794 | 568 |
| 11-B | 1.2 | 0.2 | 1028 | 1025 | 983 | 997 | 940 | 772 |
| 11-C | 4.0 | 0.8 | 1099 | 1084 | 999 | 999 | 981 | 904 |
| 11-D | 12.0 | 2.3 | 904 | 918 | 913 | 920 | 912 | 772 |
| 11-E | 40.0 | 7.7 | 797 | 764 | 746 | 767 | 785 | 810 |
| Control Sol | 0 | 0 | 1077 | 796 | 655 | 500 | 181 | 33 |

The above results show that the iodide ion has a very pronounced inhibiting action on guar degradation at 93° C., as evidenced by the viscosities of sols 11-A through 11-E after 121 hours in contrast to the control sol.

The sols of Example 11 can be drilling muds, e.g., with the suspension therein of a weighting agent such as clay (bentonite, for example) or other commonly employed additives, such as viscosity-controlling polymers. For a hydraulic fracturing fluid, the sols can be combined with a beaker additive, which degrades the thickener after a delayed period of time. Such additives are described in U.S. Pat. No. 4,169,798. A propping agent also can be added.

EXAMPLE 12

The procedure described in Example 11 was repeated except that the guar gum was underivatized (natural) guar, and the concentration of the potassium chloride solution was 2%. The results were as follows:

| Sol No. | KI (g) | $I^-$ (%) | Viscosity (cp) at Age 1 hr | 2 hrs. | 19.5 hrs. | 25 hrs. | 44 hrs. |
|---|---|---|---|---|---|---|---|
| 12-A | 0.4 | 0.08 | 1503 | 1393 | 630 | 469 | 273 |
| 12-B | 1.2 | 0.2 | 1431 | 1393 | 804 | 653 | 398 |
| 12-C | 4.0 | 0.8 | 1399 | 1373 | 772 | 680 | 412 |
| 12-D | 12.0 | 2.3 | 1400 | 1385 | 863 | 738 | 461 |
| Control Sol | 0 | 0 | 1343 | 608 | 30 | 20 | 19 |

Although a bactericide was not used in the above experiments to inhibit bacterial action on the guar, the results obtained with sols 12-A through 12-D in contrast to those obtained with the control sol nevertheless show the pronounced inhibiting action that iodide ion has on guar degradation at 93° C.

I claim:

1. A method of inhibiting the thermal degradation of a thickener for water in a polysaccharide-thickened or gelled aqueous solution or slurry, said polysaccharide being selected from the group consisting of natural and derivatized galactomannans, derivatized cellulose and starch said method comprising incorporating in the solution or slurry a thermally stabilizing amount of iodide ion compound selected from the group consisting of hydriodic acid, ammonium iodide, an alkyl-substituted ammonium iodide, or an alkali metal or alkaline-earth metal iodide, iodate ion compound selected from the group consisting of iodic acid, ammonium iodate, an alkyl-substituted ammonium iodate, or an alkali metal or alkaline-earth metal iodate, or a combination of said iodide and iodate ion compound, said solution or slurry being devoid of gas bubbles formed (a) by the decomposition of hydrogen peroxide when the inhibitor contains iodide ion and (b) by the decomposition of a nitrogen compound when the inhibitor contains iodate ion; and the stabilizing amount of iodate ion being up to 0.3 percent of the weight of said solution or slurry; with the provisio that when said solution or slurry is thickened with an iodinated water-dispersible starch or gum, said solution or slurry is iodide-free and stabilized by incorporating iodate ion therein.

2. A method of claim 1 wherein substantially all of the iodine present in the solution or slurry is chemically combined iodine.

3. A method of claim 2 wherein substantially all of the iodine present in the solution or slurry is in the form of iodide.

4. A method of claim 1 wherein said polysaccharide is selected from the group consisting of natural and derivatized galactomannans and derivatized cellulose.

5. A method of claim 1 wherein said solution or slurry is a water-based drilling fluid.

6. A method of claim 5 wherein said drilling fluid has dissolved therein potassium or sodium iodide or potassium or sodium iodate.

7. A method of claim 1 wherein said solution or slurry is an hydraulic fracturing fluid.

8. A method of claim 7 wherein said fracturing fluid has dissolved therein potassium or sodium iodide or potassium or sodium iodate.

9. In a thickened or gelled aqueous solution or slurry comprising an aqueous phase containing a polysaccharide water-thickener selected from the group consisting of natural and derivatized galactomannans, derivatized cellulose and starch, the improvement comprising an inhibitor of the thermal degradation of said thickener, said inhibitor comprising iodide ion compound selected from the group consisting of hydriodic acid, ammonium iodide, an alkyl-substituted ammonium iodide, or an alkai metal or alkaline-earth metal iodide, iodate ion compound selected from the group consisting of iodic acid, ammonium iodate, an alkyl-substituted ammonium iodate, or an alkali metal or alkaline-earth metal iodate, or a combination of said iodide and iodate ion compound, said solution or slurry being devoid of gas bubbles formed (a) by the decomposition of hydrogen peroxide when the inhibitor contains iodide ion and (b) by the decomposition of a nitrogen compound when the inhibitor contains iodate ion, and the ammount of iodate ion in said solution or slurry being up to 0.3 percent of the weight thereof; with the proviso that any solution or slurry thickened with an iodinated water-dispersible starch or gum is iodide-free and the inhibitor therein is iodate ion.

10. A solution or slurry of claim 9 wherein said polysaccharide is selected from the group consisting of galactomannans and derivatized cellulose.

11. A water-based drilling fluid comprising the solution or slurry of claim 9.

12. A hydraulic fracturing fluid comprising the solution or slurry of claim 9.

13. A solution or slurry of claim 9 wherein substantially all of the iodine present therein is chemically combined iodine.

14. A solution or slurry of claim 13 wherein substantially all of the iodine present therein is in the form of iodide.

15. A solution or slurry of claim 13 having an aqueous phase which have been gelled by the crosslinking of said thickener therein resulting from the action of a crosslinking agent distinct from said iodide.

* * * * *